United States Patent [19]

Yamada et al.

[11] 4,082,441

[45] Apr. 4, 1978

[54] METHOD AND APPARATUS FOR PRODUCING AND FIXING A VISIBLE IMAGE ON A THERMOPLASTIC LAYER OF A PHOTOCONDUCTIVE MATERIAL

[75] Inventors: Yukio Yamada; Michiharu Abe; Akiyoshi Oride, all of Tokyo, Japan

[73] Assignee: Ricoh Co. Ltd., Tokyo, Japan

[21] Appl. No.: 636,392

[22] Filed: Dec. 1, 1975

[30] Foreign Application Priority Data

Dec. 3, 1974 Japan ..... 49-139926

[51] Int. Cl.[2] ..... G03G 15/00

[52] U.S. Cl. ..... 355/14; 355/9

[58] Field of Search ..... 355/9, 14; 346/74 TP; 96/1.1; 340/173 TP; 178/6.6 TP; 250/550; 219/216, 502

[56] References Cited

U.S. PATENT DOCUMENTS

| | | | |
|---|---|---|---|
| 3,730,621 | 5/1973 | Sullivan | 355/9 |
| 3,795,514 | 3/1974 | Jvirblis et al. | 355/9 |

*Primary Examiner*—William M. Shoop
*Attorney, Agent, or Firm*—Frank J. Jordan

[57] ABSTRACT

In a system especially suited to holography a transparent photoconductive material comprises a glass substrate, an electroconductive heating layer formed on the substrate, a photoconductive layer formed on the electroconductive layer and a thermoplastic layer formed on the photoconductive layer. The photoconductive material is electrostatically charged and radiated with a coherent light image to produce an electrostatic image across the thermoplastic layer. An electric voltage is applied to the electroconductive heating layer to produce heat which softens the thermoplastic layer. The electrostatic force of the electrostatic image across the thermoplastic layer causes the same to deform and produce a diffraction pattern which constitutes a holographic representation of the light image. A photosensor is disposed in a position to sense the intensity of light which is diffracted by the diffraction pattern which is in the process of being formed. A differentiating circuit differentiates the output of the photosensor and produces an output signal to terminate application of the electric voltage to the electroconductive heating layer to thereby terminate heating of the photoconductive material when the first derivative of the photosensor output reaches a value of zero. This corresponds to the maxima of the photosensor output which occurs when the formation of the diffraction pattern is maximum and further application of heat would cause the diffraction pattern to dissolve. The thermoplastic layer has fast thermal response so that it solidifies quickly when heat is removed and the diffraction pattern is formed to a maximum extent.

11 Claims, 18 Drawing Figures

Fig. 9a
Fig. 9b
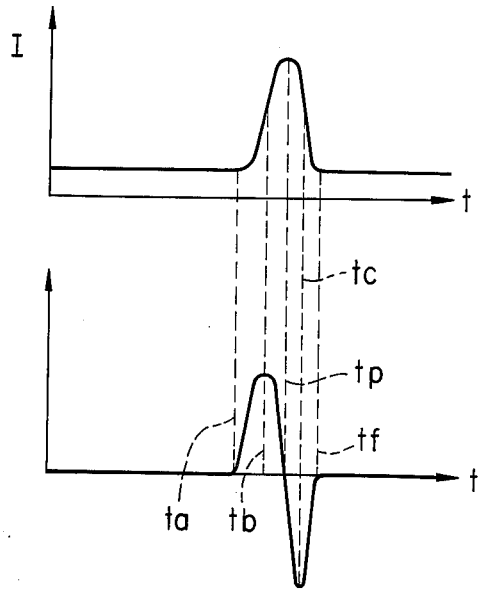
Fig. 10
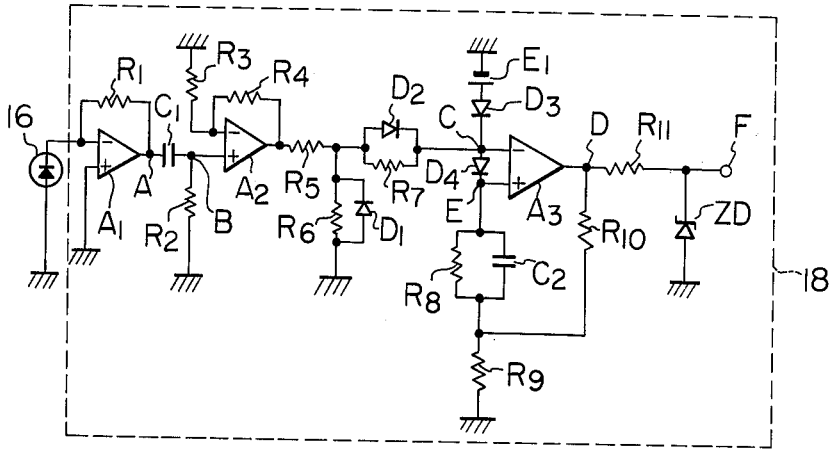

Fig. 11a
Fig. 11b
Fig. 11c
Fig. 11d
Fig. 11e
Fig. 11f
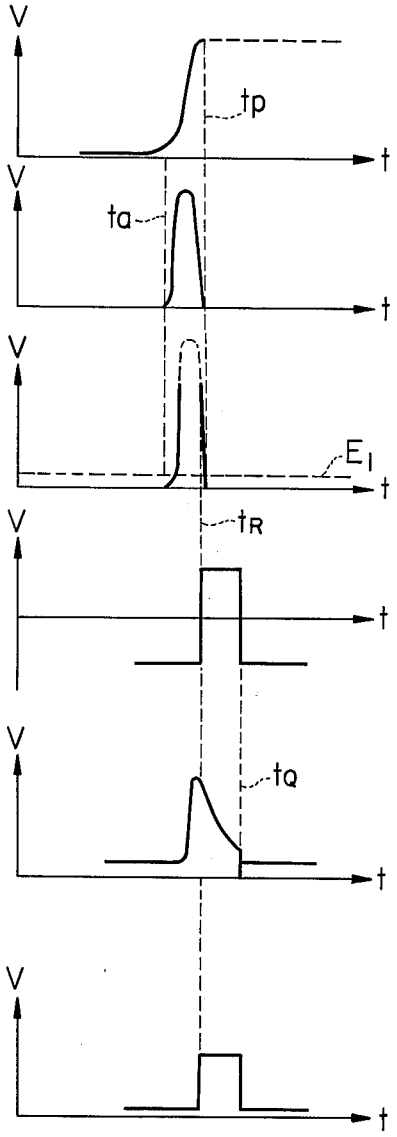
Fig. 12
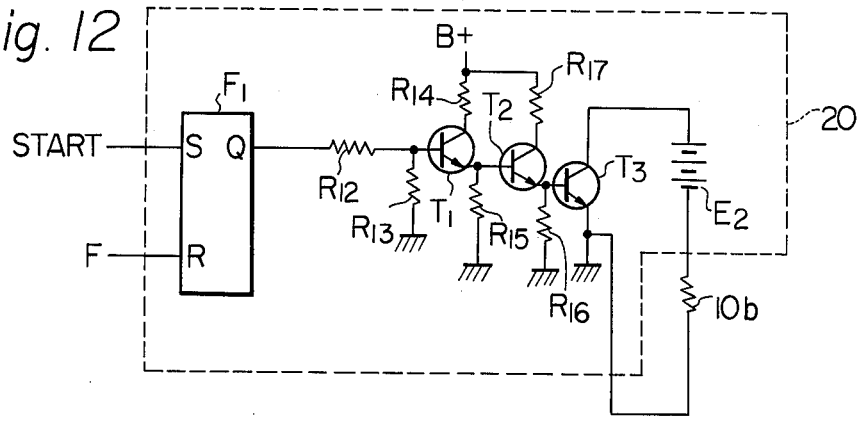

METHOD AND APPARATUS FOR PRODUCING AND FIXING A VISIBLE IMAGE ON A THERMOPLASTIC LAYER OF A PHOTOCONDUCTIVE MATERIAL

The present invention relates to a method and apparatus for producing and fixing a visible image on a thermoplastic layer of a photoconductive material, the method and apparatus being especially suited to holography.

In a field in which the present invention finds utility, such as holography, a transparent photoconductive material is provided which comprises a glass substrate, an electroconductive layer formed on the substrate, a photoconductive layer formed on the electroconductive layer and a thermoplastic layer formed on the photoconductive layer. The photoconductive material is charged electrostatically, and radiated with a light image to form an electrostatic image across the thermoplastic layer. In holography, a coherent light image is provided by a laser source, and the electrostatic image represents a holographic diffraction pattern corresponding to the light image. An electric voltage is then applied to the electroconductive layer to produce heat in accordance with Joule's principle which softens the thermoplastic layer. Since the electrostatic image produces an electrostatic force across the thermoplastic layer, the thermoplastic layer is deformed by this force so as to produce a visible diffraction pattern image of high resolution. The present invention relates to the control of heating of the thermoplastic layer.

When the thermoplastic layer is heated to its softening point, the electrostatic force will cause the diffraction image to form. However, if the thermoplastic layer is heated too long, it will soften too much and the diffraction pattern image will dissolve.

In a prior art method of controlling the rate and duration of heat application, an initial temperature of the thermoplastic layer is determined and heat is applied thereto for a length of time in dependence thereon. This method, however, is quite inaccurate in practice since the heating time is critical and is influenced by line voltage fluctuations as well as ambient temperature variations.

Another prior art method of controlling the heating time is to terminate the heating when the ratio of the intensity of light reflected from the photoconductive material to the intensity of light diffracted by the photoconductive material during the formation of the diffraction pattern reaches a predetermined value. This method, however, is also inaccurate since various parameters related to the electrostatic image such as the brightness, contract and size of the light image, variations in charging conditions caused by line voltage flucuations and the like tend to influence the formation of the diffraction pattern in such a manner that maximum diffraction pattern formation may not occur even if the above described ratio is correctly sensed. If the thermoplastic layer is heated for an insufficient period of time the diffraction pattern will not form sufficiently, and if the heating is performed for an excessive length of time the diffraction pattern will be partially or completely dissolved.

It is therefore an object of the present invention to provide a method of producing and fixing a visible image on a thermoplastic layer of a photoconductive material in a manner which overcomes the drawbacks of the prior art and assures that the image will be formed to a maximum extent.

It is another object of the present invention to provide apparatus embodying the above method.

It is another object of the present invention to provide a method of producing and fixing a visible image such as a holographic diffraction pattern on a thermoplastic layer of a photoconductive material comprising sensing the intensity of light diffracted by the photoconductive material during the formation of the diffraction pattern, differentiating said intensity and terminating heating of the thermoplastic layer when the first derivative of said intensity reaches a value of zero corresponding to a maximum value of diffraction pattern formation.

The above and other objects, features and advantages of the present invention will become clear from the following detailed description taken with the accompanying drawings, in which.

FIGS.9*a* and 9*b* are graphs illustrating an output signal from a photosensor used in the present invention and the first time derivative thereof;

FIG. 10 is an electrical schematic diagram of a sensing and computing circuit constituting part of the present apparatus;

FIGS. 11*a* to 11*f* are graphs illustrating the operation of the sensing and computing circuit shown in FIG. 10; and FIG. 12 is an electrical schematic diagram of a control circuit constituting part of the present apparatus.

Figure 1:
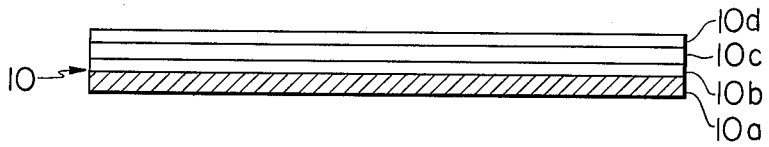
FIG. 1 is a section of a photoconductive material to which the present invention is applicable.

Referring now to FIG. 1, a photoconductive material 10 to which the present invention is applicable comprises a substrate 10*a*, an electroconductive layer 10*b* formed on the substrate 10*a*, a photoconductive layer 10*c* formed on the electroconductive layer 10*b* and a thermoplastic layer 10*d* formed on the photoconductive layer 10*c*. The entire photoconductive material 10 is transparent. The substrate 10*a* is preferably a glass plate having a thickness of 1.5mm and a size of 60 × 60mm. The electroconductive layer 10*b* is preferably a transparent electrode made of indium oxide about 0.1 micron thick and having a very low heat capacity, and is evaporated onto the substrate 10*a*. The electroconductive layer 10*b* preferably has a surface resistivity of 15 ohms/cm$^2$ and dissipates about 17W/cm$^2$ to produce heat in the present apparatus. The photoconductive layer 10*c* is about 1 to 10 microns thick, and may be formed of an organic photoelectric semiconductor. A suitable substance comprises polyvinyl carbazol and 2.4.7-trinitrofluorenon at a molecular ratio of 16:1 with a thickness of 2 microns. The thermoplastic layer 10*d* has a thickness of 0.3 to 3 microns, and may be formed of a resin ester such as a 1 micron thick film of STEBELITE ESTER 10 (a trademark of the Hercules Powder Co., Ltd. U.S.A.). The thermoplastic layer 10*d* is arranged to have a softening point between 50° and 100° C and to solidify substantially simultaneously upon termination of heating.

It will be understood that the electroconductive layer 10*b* may be replaced by a separate plate having a layer of indium oxide formed thereon which is brought into contact with the photoconductive material for heating, or alternative heating means such as hot air, thermal radiation, high frequency electromagnetic rediation or the like.

Referring now to FIGS. 2 to 5, the basic method of the present invention is illustrated. In these drawings, the substrate 10*a* omitted for simplicity of illustration.

Figure 2:
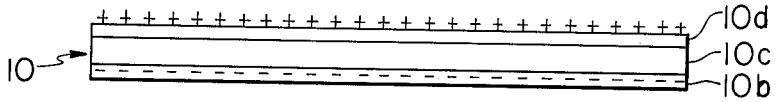
FIGS. 2 to 5 are sectional views of the photoconductive material illustrating the process steps of first charging, radiation with a light image, second charging and heating respectively in accordance with the present invention.

In FIG. 2, the photoconductive material 10 is uniformly charged in the absense of light by means such as a conventional corona discharge unit (not shown). Specifically, positive charges are present on the top (as shown) of the thermoplastic layer 10*d*, which is an electrical insulator, and nagative charges are present in the electroconductive layer 10*d*. Since the photoconductive layer 10*c* acts as an insulator in the absense of light, there is no movement of charge carriers therein caused by the charging operation.

Figure 3:
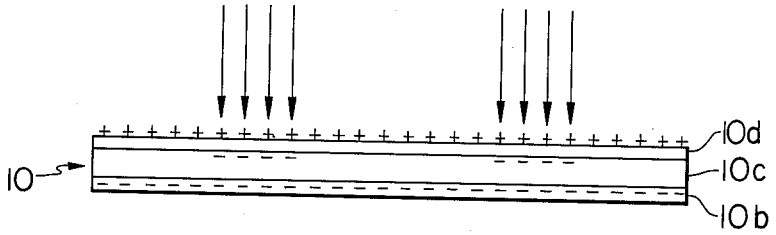

In FIG. 3, a light image is radiated onto the surface of the thermoplastic layer 10*d* by means such as laser illumination of scene as shown by arrows which represent light areas (as opposed to dark areas) of the scene. In the light areas, the photoconductive layer 10*c* is caused to conduct so that negative charges migrate to the interface of the photoconductive layer 10*c* and the thermoplastic layer 10*d*.

Figure 4:
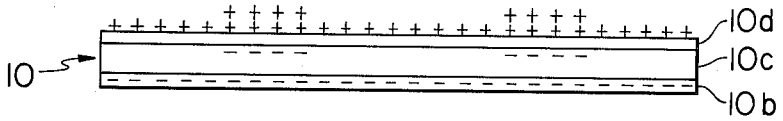

In FIG. 4, the photoconductive material 10 is charged a second time so that positive charges are attracted to the light areas of the image in which the negative charges migrated to the interface of the layers 10*c* and 10*d*.

Figure 5:
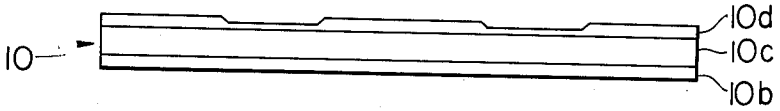

In FIG. 5, the photoconductive material 10 is heated by applying an electric voltage across the electroconductive layer 10*b* which cause current to flow therethrough and create heat through current dissipation in accordance with Joule's principle. Since the electrostatic force across the thermoplastic layer 10*d* is inversely proportional to the square of the distance between the charges and proportional to the charges, the force on the surface of the thermoplastic layer 10*d* will be greatest in the light areas of the image in which higher concentrations of positive and negative charges are disposed on the opposite surfaces of the thermoplastic layer 10*d* as shown in FIG. 4. The result is that the thermoplastic layer 10*d*, upon softening by heating, will be compressed in the light image areas as shown in FIG. 5 to create a visible image. Upon termination of heating, the thermoplastic layer 10*d* remains in the deformed condition as shown in FIG. 5 to fix the visible image on the surface of the thermoplastic layer 10*d*.

Figure 6:
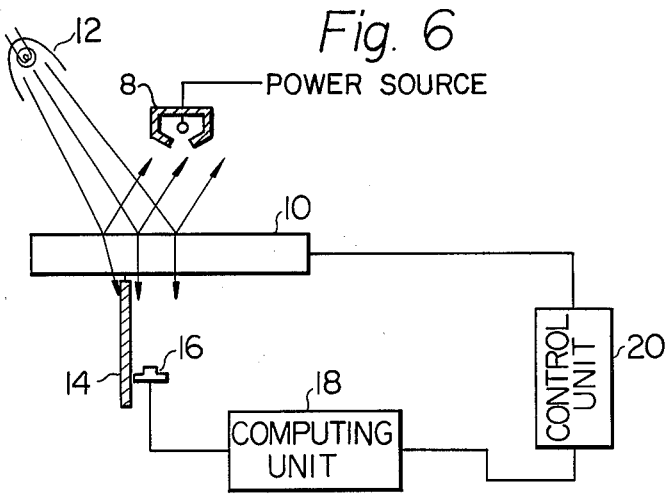
FIG. 6 is a block diagram illustrating apparatus in accordance with the present invention.

Referring now to FIG. 6, apparatus embodying the present invention comprises a corona charging device 8 to uniformly apply an electrostatic charge to the photoconductive material 10 and an imaging light source 12 to radiate a light image onto the photoconductive material 10. Although shown symbolically, the light source 12, in the case of a holographic apparatus, comprises a laser to coherently illuminate a scene for holographic reproduction and an optical system to project an image of the scene onto the photoconductive material 10. As indicated by arrows, the light image from the light source 12 is incident on the photoconductive material 10 at an angle, and during formation of the visible image on the thermoplastic layer 10*d*, which in this case is a holographic diffraction pattern, part of the light is reflected upward and part of the light is diffracted downward.

A baffle 14 is provided below the photoconductive material 10 to prevent all but a negligible amount of light from being incident on a photosensor 16 when there is no image formed on the photoconductive material 10. The photosensor 16 is, however, positioned in such a manner as to receive at least a portion of the light which is diffracted downwards by the photoconductive material 10 during formation of the diffraction pattern or image.

The output of the photosensor 16 is an electrical signal which is fed to a computing unit 18, the output of which is fed to a control unit 20. The output of the control unit 20 is fed to the electroconductive layer 10*b* to energize or de-energize the same.

Figure 7:
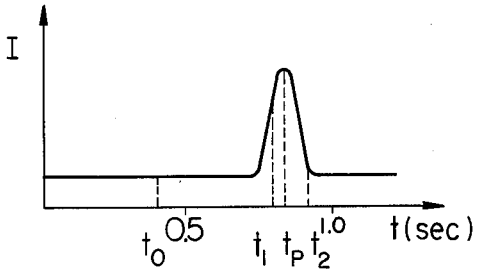
FIGS. 7 and 8 are graphs which illustrate thermoplastic and thermosensitive characteristics of a photoconductive material used in practicing the present invention.

Referring now to FIG. 7, it will be assumed that the electric voltage is applied to the electroconductive layer 10*d* and that the thermoplastic layer 10*d* is being heated. In FIG. 7, the abcissa represents time ($t$) in seconds and the ordinate represents the current output (I) of the photosensor 16.

If the electric voltage is applied to the electroconductive layer at a time $t_o$, after about 0.4 seconds an image will begin to appear on the surface of the thermoplastic layer 10*d*. The output of the photosensor 16 is initially a constant low value due to scattered light incident thereon. If the heating is not terminated, the diffraction pattern will continue to be formed until a time $t_p$, after which the diffraction pattern will begin to dissolve. At a time $t_2$, the diffraction pattern will be essentially invisible. Since a significant amount of light is directed onto the photosensor 16 only when a diffraction pattern is present on the photoconductive material 10, it will be clearly understood that the output of the photosesor 16 will be above the constant value only when a diffraction pattern is present.

Figure 8:
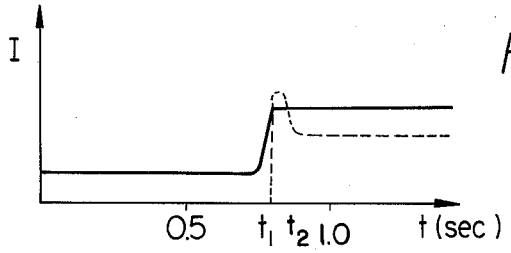

FIG. 8 represents the thermal characteristics of two types of photoconductive materials. In FIG. 8, it will be assumed that the heating is stopped at a time $t_1$. If the photoconductive material has the property of retaining heat for a significant amount of time after the heating is terminated, after the time $t_1$ the output of the photosensor 16 will resemble a broken line curve. It well be seen that the final value of the output of the photosensor 16 is quite lower than the peak of the photosensor 16 output curve. However, if the photoconductive material does not have the property of retaining heat, a solid line curve as shown in FIG. 8 will result, which curve has a higher final value. It is this latter type of photoconductive material, having a small heat capacity, which is preferably utilized in the present invention.

FIG. 9*a* is essentially identical to FIG. 7 and is provided for purposes of clear comparison with FIG. 9*b*. FIG. 9*b* is a graph which shows the first derivative of the curve of FIG. 9*a* with respect to time. It will be assumed that the output of the photosensor 16 begins to rise at a time $t_a$ and continues to rise to a peak or maximum at the time $t_p$. A time $t_b$ represents an inflection point of the curve of FIG. 9*a* between the times $t_a$ and $t_p$. Another inflection point of the curve of FIG. 9*a* occurs between the times $t_p$ and $t_f$ at a time $t_c$.

It is well known in differential calculus that maxima and minima of first derivative curves correspond to inflection points of the original curves and that zero points of first derivative curves correspond to maxima and minima of the original curves. In FIG. 9*b*, a maxima appears at the time $t_b$ which corresponds to the inflection point in the rising (positive slope) portion of the curve of FIG. 9*a*. Similarly, a minima appears in the curve of FIG. 9*b* at the time $t_c$ which corresponds to the inflection point in the falling (negative slope) portion of the curve of FIG. 9*a*.

In accordance with an important feature of the present invention, a zero point appears in the curve of FIG. 9*b* at the time $t_p$ which corresponds to the maxima in the curve of FIG. 9*a*. This will be described in more detail below with reference to the circuit diagram of FIG. 10.

Referring now to FIG. 10, the computing unit 18 comprises an operational amplifier A1 having a negative input terminal connected to the output of the photosensor 16. A positive input terminal of the operational amplifier A1 is grounded. A feedback resistor R1 is connected between the negative input terminal and the output terminal of the operational amplifier A1.

The output of the operational amplifier A1 is grounded through a capacitor C1 and a resistor R2. The junction of the capacitor C1 and the resistor R2 is connected to the positive input terminal of an operational amplifier A2. A feedback resistor R4 is connected between the output terminal of the operational amplifier A2 and the negative input terminal therof, the negative input terminal being grounded through a resitor R3.

The output terminal of the operational amplifier A2 is grounded through resistors R5 and R6. A diode D1 is connected in parallel with the resistor R6, with the anode of the diode D1 being grounded.

The junction of the resistors R5 and R6 is connected to the negative input terminal of an operational amplifier A3 through a resistor R7. A diode D2 is connected in parallel with the resistor R7 with the cathode of the diode D2 being connected to the negative input terminal of the operational amplifier A3. The negative terminal of a bias voltage source E1 is grounded, and the positive terminal thereof is connected to the anode of a diode D3. The cathode of the diode D3 is connected to the negative input terminal of the operational amplifier A3. A diode D4 is connected between the negative and positive input terminals of the operational amplifier A3, with the anode of the diode D4 being connected to the negative input terminal. The positive input terminal of the operational amplifier A3 is connected to ground through resistors R8 and R9. A capacitor C2 is connected in parallel with the resistor R8. The output of the operational amplifier A3 is connected to the junction between the resistors R8 and R9 through a resistor R10. The output terminal of the operational amplifier A3 is grounded through a resistor R11 and a zener diode ZD, with the anode of the zener diode Z*d* being grounded. An output terminal of the computing unit 18 is designated as F.

The control unit 20 is shown in FIG. 12. The output terminal F of the computing unit 18 is connected to a reset terminal of a bistable element or flip-flop F1, a set terminal of which is connected to receive a signal START. The output of the flip-flop F1 is grounded through resistors R12 and R13. The junction of the resistors R12 and R13 is connected to the base of an NPN transistor T1, the emitter of which is grounded through a resistor R15. The collector of the transistor T1 is connected to a B+ voltage source. The emitter of the transistor T1 is connected to the base of an NPN transistor T2, the emitter of which is grounded through a resistor R16. The collector of the transistor T2 is connected to the B+ supply.

The emitter of the transistor T2 is connected to the base of an NPN transistor T3, the emitter of which is grounded. The collector of the transistor T3 is connected to a positive terminal of a heater voltage source E2, the negative terminal of which is grounded through the electroconductive layer 10*b*.

The transistors T1 and T2 serve as amplifiers, and the transistor T3 serves as a switch. In operation, when the START signal is applied to the set terminal of the flip-flop F1, the output is high which turns on the transistors T1, T2 and T3 thereby energizing the electroconductive layer 10*b* with the voltage of the source E2. When a pulse is applied from the output terminal F of the computing unit 18 to the reset input terminal of the flip-flop F1, the output of the flip-flop F1 is low thereby turning off the transistors T1, T2 and T3 and de-energizing the electroconductive layer 10*b* to terminate heating of the thermoplastic layer 10*d* of the photoconductive material 10.

In operation, the photoconductive material 10 is charged as described with reference to FIG. 2 and radiated by the light source 12. It will be understood that the second charging step of FIG. 4 may be omitted if desired. The steps of radiation of the light image and heating of the photoconductive material 10 may be performed either simultaneously or in sequence. In the latter case, the heating is performed after imaging.

It will be assumed that the electrostatic image has been produced as shown in FIG. 4 and that the START signal has been applied to the flip-flop F1 thereby energizing the electroconductive layer 10*b* to begin heating the thermoplastic layer 10*d*.

Referring to FIG. 10, the operational amplifier A1 serves to amplify the signal from the photosensor 16, and its output is designated as A. The capacitor C1 and resistor R2 constitute a differentiating circuit, the output of which is designated as B. The operational amplifier A2 serves to amplify the output signal of the differentiating circuit constituted by the capacitor C1 and resistor R2. The resistor R6 and diode D1 serve to clamp the junction of the resistors R5 and R6 to ground when the output of the operational amplifier A2 is negative. The resistor R7 and diode D2 serve to clamp the negative input terminal of the operational amplifier A3 to the voltage of the bias source E1 when the voltage at the junction of the resistors R5 and R6 is less than the bias voltage E1. The capacitor C2 and resistor R8 constitute a time constant circuit as will be described below. The zener diode ZD limits the output of the operational amplifier A3 to produce a square wave.

FIGS. 11*a* to 11*f* represent the voltages (V) at points A to F in the circuit diagram of FIG. 10 respectively. Initially, the voltage at the point A is constant so that the first time devivative thereof, which appears at the point B, is zero. At the time $t_a$, the diffraction pattern begins to appear on the thermoplastic layer 10*d* as the result of heating the same, and the output of the photosensor 16 and thereby the operational amplifier A1 which appears at the point A begin to rise as shown in FIG. 11*a*. The differentiated signal at point B also rises as shown in FIG. 11*b*. The diode D2 will remain reverse biased to clamp the negative input terminal (point C) of the operational amplifier A2 to the bias voltage E1 until the voltage at the junction of the resistors R5 and R6 exceeds E1. At this time the voltage at point C will begin to rise as shown in FIG. 11*c*. Since the diode D4 has finite resistance, the voltage at point C will be higher than that at point E, and the operational amplifier A2 will produce a negative output as shown in FIG. 11*d* at the point D. The output F of the computing unit 18 will thereby be essentially zero.

As the voltages at points A, B and C rise, the capacitor C2 will begin to charge quickly through the diode D4 as shown in FIG. 11*e*. As long as the voltage at point C is rising, the voltage at point E cannot exceed the voltage at point C due to the finite resistance of the diode D4. When, however, the peak of the voltage curve of FIG. 11*c* is reached and the voltage at point C begins to decrease, the diode D4 will be reverse biased. As the voltage at point C further drops, it will drop below that at point E at a time $t_r$ and the operational amplifier A3 will produce a positive output as shown in FIG. 11*d*. An amplitude limited output pulse will appear at the point F, which is applied to the reset terminal of the flip-flop F1 to reset the flip-flop F1 and terminate the heating of the photoconductive material 10 as described above.

With the diode D4 reverse biased, the capacitor C2 will discharge through the resistor R8 as shown in FIG. 11*e*. In dependence on the shape of the curve of FIG. 11*c* and the time constant of the combination of the capacitor C2 and resistor R8, the voltage at the point E will drop below that at the point C at a time designated as $t_q$. The operational amplifier A3 will then produce again a negative output (point D) and the output pulse at the point F will be terminated.

Although the time $t_r$ is shown as being before the time $t_p$ in FIG. 11*c*, by proper selection of the amplification factor of the operational amplifier A2 the times $t_r$ and $t_p$ can be made so close together that the time difference will be negligible. It can be said, therefore, that the heating is terminated at substantially the same time the peak of the output of the photosensor 16 is reached. In this manner, the desired results are attained in that the heating of the thermoplastic layer 10*d* is stopped at the instant that the diffraction pattern or visible image is formed to a maximum extent.

Since the entire image can be reproduced from any section of a hologram, the photosensor 16 may be adapted to receive light from any small section of the photoconductive material 10. This will result in a very compact apparatus.

In experiments using the apparatus, electrostatic images were thermally developed and fixed in which the contrast range was from 1 to 15 for various test images. In all cases, measurements confirmed that the resulting images had the greatest possible diffraction efficiency. It was further proven that the apparatus operated perfectly despite fluctuations in the voltage of the power source E2 of ± 15%, fluctuations in the initial temperature of the photoconductive material 10 of up to 40° C and variations in the surface resistivity of the electroconductive layer 10*b* of up to 30%.

The present invention is not restricted to holography, and the light source 12 may be a laser, tungsten lamp, light emitting diode or the like. If desired, a timer (not shown) may be provided to limit the heating time to, for example, 3 seconds to positively prevent damage to the photoconductive material 10.

It will be noticed that the image on the thermoplastic layer 10*d* may be thermally erased, so that the photoconductive material 10 may be used over again many times.

Many modifications within the scope of the invention will become possible to those skilled in the art after receiving the teachings of the present disclosure.

What is claimed is:

1. In a method of producing and fixing a visible image on a photoconductive material, the photoconductive material comprising a photoconductive layer on which a transparent thermoplastic layer is formed, the steps of:

(a) radiating a light image onto the thermoplastic layer;

(b) heating the thermoplastic layer to a softening point thereof;

(c) sensing an intensity of the light image at a point to which the light image is diffracted by the visible image being formed on the photoconductive material;

(d) automatically electronically computing the rate of change of the sensed intensity of the light image in a manner as to differentiate the sensed intensity; and (e) automatically terminating the application of heat to the thermoplastic layer when the rate of change of intensity of the light image reaches a value substantially equal to zero.

2. The method of claim 1, in which an electrically conductive layer is formed on a surface of the photoconductive layer opposite to a surface of the photoconductive layer on which the thermoplastic layer is formed, step (b) comprising applying an electric voltage to the electrically conductive layer to produce heat therein and thereby apply heat to the thermoplastic layer.

3. The method of claim 1, in which steps (a) and (b) are performed simultaneously.

4. Apparatus for producing and fixing a visible image on a photoconductive material, the photoconductive material having a photoconductive layer on which a transparent thermoplastic layer is formed, comprising:

imaging means for radiating a light image onto the thermoplastic layer;

heating means for heating the thermoplastic layer to a softening point thereof;

sensing means arranged to sense an intensity of the light image at a point to which the light image is diffracted by the visible image being formed on the photoconductive member;

computing means for computing the rate of change of the sensed intensity of the light image, said computing means comprising a differentiating circuit; and control means operative to de-energize the heating means when the rate of change of intensity of the light image reaches a value substantially equal to zero.

5. The apparatus of claim 4, in which an electrically conductive layer is formed on a surface of the photoconductive layer opposite to a surface of the photoconductive layer on which the thermoplastic layer is formed, the heating means being operative to apply an electric voltage to the electrically conductive layer to produce heat therein and thereby apply heat to the thermoplastic layer.

6. The apparatus of claim 4, in which the photoconductive material has a property that the thermoplastic layer will solidify substantially simulataneously with de-energization of the heating means.

7. The apparatus of claim 4, in which the sensing means comprises a photosensor.

8. The apparatus of claim 4, further comprising charging means to apply an electrostatic charge to the photoconductive material prior to radiating the light image onto the photoconductive material and heating the thermoplastic layer.

9. The apparatus of claim 5, in which the electrically conductive layer comprises indium oxide.

10. The apparatus of claim 4, in which the control means comprises a bistable element to energize and de-energize the heating means.

11. The apparatus of claim 5, in which the photoconductive material further comprises a substrate bonded to the electrically conductive layer to support the electrically conductive layer, photoconductive layer and thermoplastic layer.

* * * * *